US007126339B2

(12) United States Patent
Nagai et al.

(10) Patent No.: US 7,126,339 B2
(45) Date of Patent: Oct. 24, 2006

(54) UTILITY IRON GOLF CLUB WITH WEIGHTING ELEMENT

(75) Inventors: Masao Nagai, Suwanee, GA (US); David G. Llewellyn, Duluth, GA (US)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/209,297

(22) Filed: Jul. 31, 2002

(65) Prior Publication Data

US 2004/0023730 A1 Feb. 5, 2004

(51) Int. Cl.
*A63B 53/04* (2006.01)

(52) U.S. Cl. ..... 324/345; 324/291; 324/349

(58) Field of Classification Search ..... 473/334, 473/349, 350, 291
See application file for complete search history.

(56) References Cited

U.S. PATENT DOCUMENTS 4,247,105 A * 1/1981 Jeghers ..... 473/291
4,398,965 A 8/1983 Campau
5,048,835 A * 9/1991 Gorman ..... 473/350
5,090,702 A 2/1992 Viste
5,184,823 A 2/1993 Desboilles et al.
5,242,167 A * 9/1993 Antonious ..... 473/350
5,255,918 A * 10/1993 Anderson et al. ..... 473/330
5,921,869 A * 7/1999 Blough et al. ..... 473/291
5,967,903 A 10/1999 Cheng
6,030,295 A * 2/2000 Takeda ..... 473/345
6,554,722 B1 * 4/2003 Erickson et al. ..... 473/334

* cited by examiner

*Primary Examiner*—Glenn Caldarola
*Assistant Examiner*—Tom P. Duoung
(74) *Attorney, Agent, or Firm*—Troutman Sanders LLP; Gerald R. Boss

(57) ABSTRACT

A golf club head comprising of a front plate integral with a primary body having a top, a sole, a rear portion, and a general periphery wherein the primary body and the front plate define a hollow interior and where the rear portion carries a weighting element that protrudes behind the general periphery.

1 Claim, 2 Drawing Sheets

UTILITY IRON GOLF CLUB WITH WEIGHTING ELEMENT

BACKGROUND OF THE INVENTION

This invention relates to a golf club head and more particularly to an improvement of a utility iron.

Long irons, low lofted irons, often provide a challenge to some golfers because the low loft of the club causes the golf club head to be in a more upright position. This upright position raises the center of gravity of the golf club head making it more difficult to elevate a golf shot because more weight of the golf club head is located above the center of gravity of the golf ball. To address this problem, many high handicap golfers will chose to use fairway woods instead of long irons. Fairway woods generally have a lower center of gravity to make elevating the golf ball easier. However, fairway woods are also usually longer and the design of the club head makes controlling the rotation of the club head more difficult. Therefore, fairway woods are generally less accurate than long irons.

To address the problems of both long irons and fairway woods, two types of golf clubs have been designed, utility woods and utility irons. Utility woods typically have a hollow interior and the same general shape as a fairway wood (toe of the club is roughly the same height as the heel of the club), but the head of a utility wood is generally smaller than that of a typical fairway wood. The smaller head helps lower the center of gravity; however, utility woods still retain the same characteristics that make them less accurate than long irons.

Utility irons also have a hollow interior, but they retain the general shape of an iron (the toe of the club is generally higher than heel of the club). The advantage to this head design is that it reduces club face rotation for golf shots that are hit either on the toe and the heel of the golf club and therefore generally makes utility irons more accurate than utility woods.

There are two deficiencies with the utility irons that are currently manufactured. First, utility irons fail to utilize a face design in which the face of the golf club head has different thicknesses. A spring-like or trampoline effect occurs when the face flexes inward upon initial contact with the golf ball and flexes outward as the ball loses contact with the face generating a higher initial velocity of a golf ball than if the face did not flex. The amount that the face of a golf club flexes is measured by the Coefficient of Restitution (COR). The higher the COR, the more flex the face will have and therefore the greater the initial ball velocity will be. To increase the COR in irons, some manufactures have developed a variable face thickness in which the back side of the face is dome shaped so that the face is thicker in the middle. However, this design is inefficient because it reinforces areas unnecessarily, which both decreases the COR and prevents that weight from being distributed to either increase the moment of inertia or to lower the center of gravity. The second deficiency of current utility irons is that the center of gravity of most utility irons is still too high for some golfers to effectively use these clubs. Because it is necessary to maintain an effective swing weight of a golf club, it is impractical to simply attach a large weight across the entire sole of the golf club. This invention provides an innovative solution to both of these problems.

SUMMARY OF THE INVENTION

The invention contemplates a novel and improved golf club head. The present invention is an improvement over prior art by providing a golf club head with a hollow interior and a weighting element attached to the periphery of the back of the golf club head to lower its center of gravity.

In an alternative embodiment this invention also utilizes different thickness in the face of a utility golf club iron to increase the initial velocity of the golf ball. The areas of varying thicknesses generate a spring-like or trampoline effect in the face of the golf club to increase the initial velocity of the golf ball. To maximize this trampoline effect, the face generally has three different thicknesses; the center of the face where the golf ball generally impacts is the thickest area, the top portion of the club is thinner than the center of the face, and the bottom portion is thicker than the top portion but thinner than the center of the face.

It is therefore an object of the present invention to provide an effective game improvement utility iron.

DETAILED DESCRIPTION OF THE INVENTION

Figure 1:
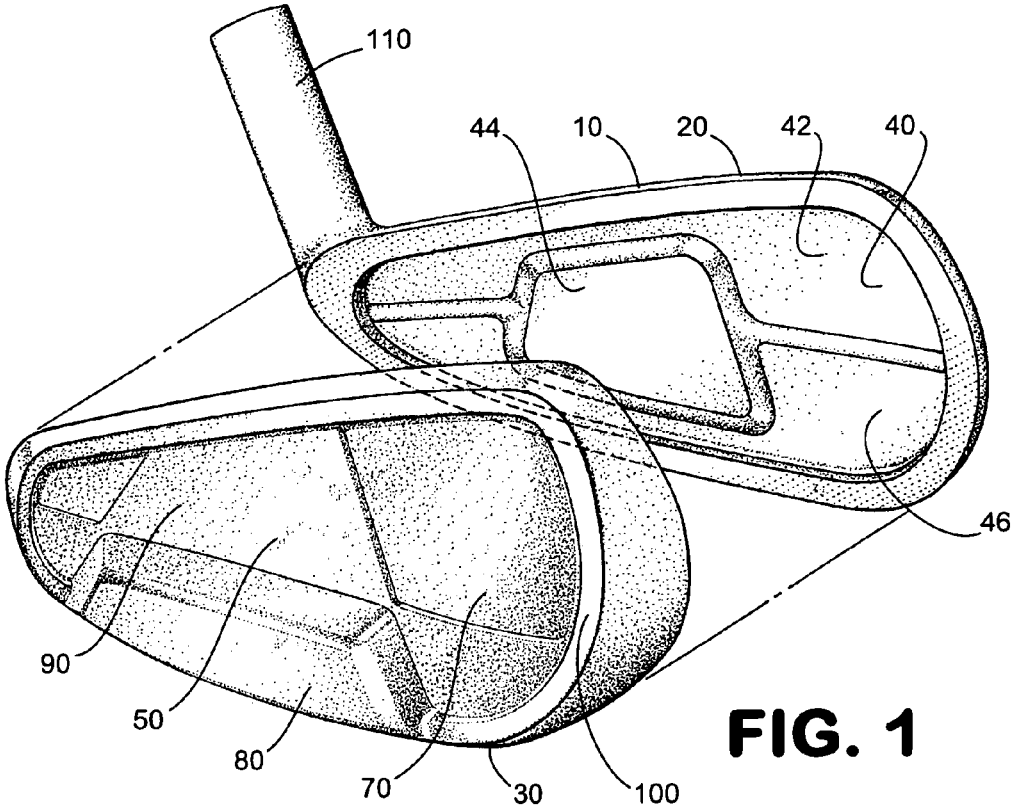
FIG. 1 is a perspective view of the back of a golf club iron showing the front plate detached from the main body.
Figure 2:
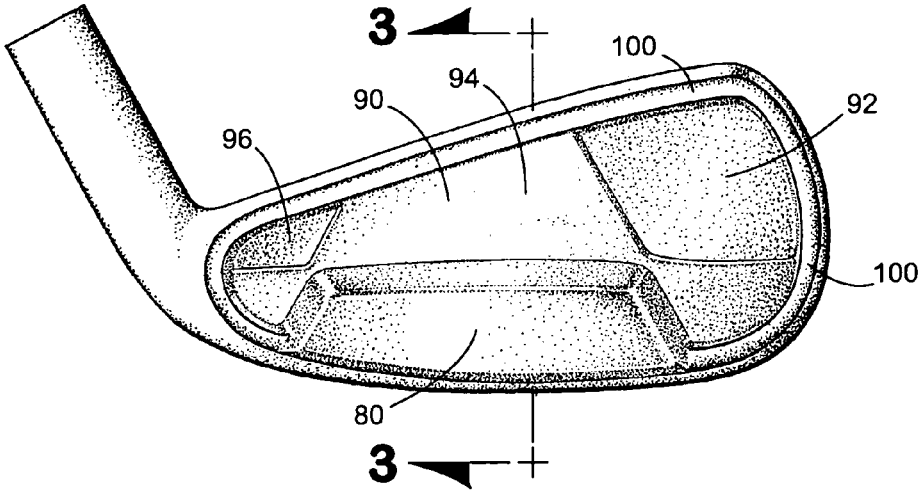
FIG. 2 is a rear elevation of the rear of the iron shown in FIG. 1.
Figure 3:
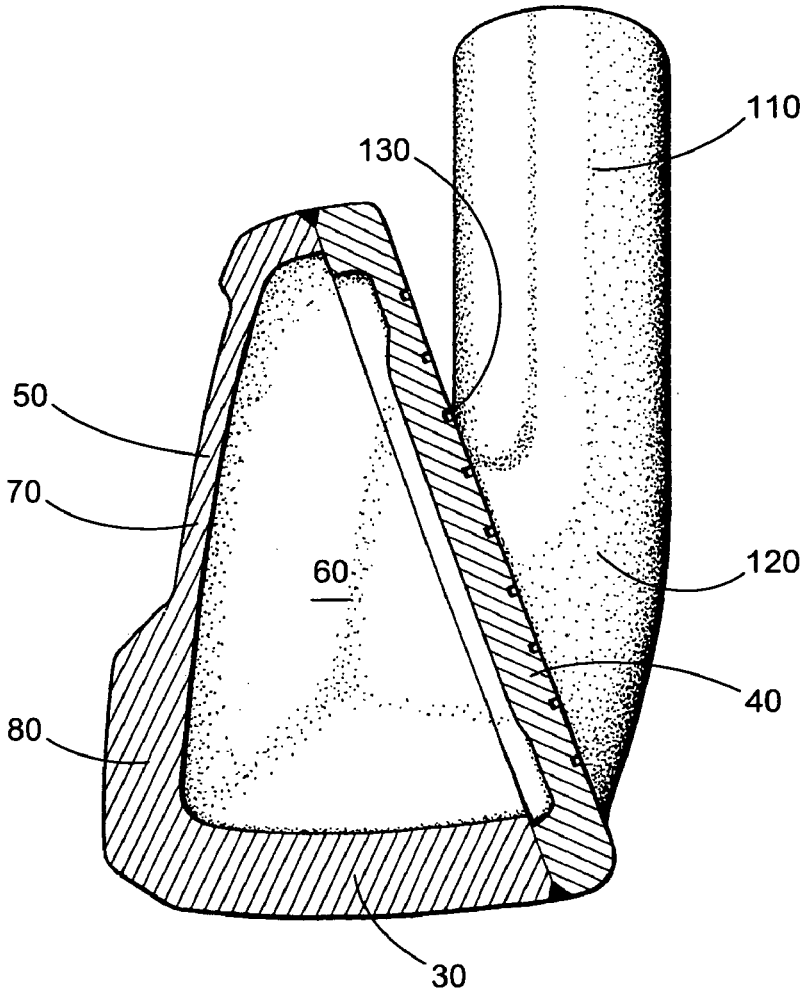
FIG. 3 is a planar cross-section taken along lines 3—3 in FIG. 1.

Referring now in more detail to the drawings, as can be seen in FIGS. 1,2, and 3, the golf club head 10 having a front plate 40 integral with a primary body 50 having a top 20, a sole 30, and a rear portion 90, forming a general periphery 70 wherein the primary body 50 and the front plate 40 define a hollow interior 60 and where the rear portion carries a weighting element 80 that protrudes behind the general periphery 70.

The weighting element 80 illustrated in FIG. 2 can be a trapezoid-like shaped bar that attaches to the rear portion 90 of the golf club head 10 and partially protrudes behind the general periphery 70 of the primary body 50. In addition, the rear portion 90 of the golf club head 10 in this embodiment is divided into three sections; the toe section 92, the middle section 94, and the heel section 96. The weighting element 80 is located on the middle section 94 to create a low, deep center of gravity, which generates a high launch angle.

The rear portion 90 of the golf club head 10 can also be modified to further lower the center of gravity by varying the thicknesses of the different sections. Generally speaking, the middle section 94 is thicker than the toe section 92 and the heel section 96. The toe 92 and heel 96 sections are thinner to lower the center of gravity. In one embodiment, the toe 92 and heel 96 sections are approximately 1.5 mm thick, the middle section 94 in the area without the weighting element 80 is approximately 1.5 mm thick, and the middle section 94 in the area with the weighting element 80 is approximately 4.5 mm thick. Also, unlike the front plate 40 which has a uniform exterior surface (discounting the grooves) wherein the different thicknesses are evident on the interior surface of the front plate 40, the rear portion 90 has a uniform interior surface with the different thicknesses of the rear portion 90 being formed on the exterior surface of the rear portion. In addition, the exterior surface may slope between the areas of different thicknesses as evidenced in FIG. 2.

Further, the rear portion 90 of the golf club head 10 can be surrounded by a perimeter weighting element 100 that is designed to increase the moment of inertia of the golf club head 10 by distributing mass away from the center of gravity of the golf club head 10. As discussed previously, increasing the moment of inertia makes the golf club more resistant to rotation around the center of gravity, which allows less energy to be lost on golf shots that are not struck by the middle of the front plate 40. The large moment of inertia creates a large "sweet spot" by reducing this rotation. In one embodiment, the moment of inertia for rotation around the center of gravity of the golf club head 10 for the 18°, 21°, and 24° lofted clubs would be 2250 $gcm^2$, 2287 $gcm^2$, and 2318 $gcm^2$ respectively.

The front plate 40 is generally made out of a forged material, such as grain flow forged 304N2 steel. This material is thin and strong, but it is also soft, which allows it to be bent for custom fitting of the golf club. The front plate 40 can then be welded to the primary body 50. A hosel 110 connects to the front plate 40 to allow a golf shaft to be attached. The hosel 110 includes a neck 120 connected to the heel portion of the front plate 40. Front plate 40 also has a 15 series of grooves 130. The grooves 130, in one embodiment, are 0.4 mm deep and 0.8 mm wide and are spaced 3.6 mm apart from each other. This embodiment contains two sets of grooves 130, one having equal length and one having varying groove length; however, it would be obvious to one skilled in the art to manufacture to make alterations thereof. Typical values for a few of the dimensions of some the clubs that embody the invention are listed below.

| Club Loft | Bounce | Lie | Maximum Sole Width |
|---|---|---|---|
| 18° | 1° | 58.5° | 30.015 mm |
| 21° | 2° | 59° | 29.986 mm |
| 24° | 2° | 59.5° | 29.946 mm |

As previously discussed, the front plate 40 and the primary body 50 define a hollow interior 60. This type of hollow technology allows the golf club head 10 to have a low center of gravity and a large moment of inertia for rotation from the toe 140 to the heel 150 of the golf club head 10 around the center of gravity of the golf club head 10. The moment of inertia is increased due to the hollow interior because mass is removed from away from the center of gravity of the golf club head 10. The golf club head 10 is therefore more resistant to rotation around the center of gravity of the golf club head 10. The volume of the hollow interior 60 can be adjusted depending on the desired characteristics of the golf club head 10, but one embodiment has design volumes of 34.77 cc, 34.54 cc, and 34.3 cc for 18°, 21°, and 24° lofted clubs respectively. The actual volume of the hollow interior 60 is difficult to measure but can be expected to be between 30 cc and 40 cc for all embodiments of this club.

The center of gravity of the golf club head is lower and deeper than a typical golf club head having a similar loft because of the distribution off the mass of the golf club head. The center of gravity, generally less than 22 mm from the sole of the club, allows for a high launch angle given the relatively low lofts of these utility irons. In one embodiment, the sweet spot heights are 20.7, 20.95, and 20.63 mm for the 18°, 21°, and 24° lofted clubs respectively. The higher launch angle of a golf ball upon impact with the golf club head 10 is directly attributed to the location of the center of gravity of the golf club head.

In a separate embodiment of the invention, illustrated in FIGS. 1, the golf club head 10 includes a front plate 40 integral with a primary body 50 having a top 20, a sole 30, and a rear portion 90, forming a general periphery 70 wherein said primary body 50 and said front plate 40 define a hollow interior 60 and where said rear portion 90 carries a weighting element 80 that protrudes behind said general periphery 70, wherein said front plate 40 has three thicknesses; a top portion 42 having a given thickness, a middle portion 44 below said top portion 42 having a thickness greater than the top portion 42, and a sole portion 46 below both the top portion 42 and the middle portion 44 having a thickness greater than said top portion 42 but thinner than said middle portion 44.

As seen in FIGS. 1, the front plate 40 consists of three parts, a top portion 42, a middle portion 44, and a sole portion 46. The thicknesses of these portions of the front plate can be adjusted to optimize the flex of the front plate upon impact with a golf ball. Flex of the front plate 40 creates a spring-like effect or trampoline effect where upon impact with a golf ball, the golf ball will compress and the front plate 40 will flex inward into the hollow interior 60, then as the golf ball expands, the front face 40 will flex outward and will propel the golf ball away from the front plate 40 with a greater initial velocity than if the front plate 40 did not flex. To optimize the flex of the front plate 40, the middle portion 44 where a golf ball generally impacts the front face will be the thickest area of the front plate 40, the top portion 42 will be thinner than the middle portion 44, and the sole portion 46 will be thicker than the top portion 42 but thinner than the middle portion 44. As illustrated by FIG. 1, one embodiment to optimize the flex of the front plate 40, the middle portion 44 will be encircled by the top 42 and the sole portion 46 so that the middle portion 44 will be offset from both the toe 140 and the heel 150 of the golf club.

The front face 40 contains regions that are naturally more rigid than others. Therefore, regions need more or less support depending on how rigid the region is and how durable the region needs to be. By differentiating the regions by these two factors, it is possible to optimize the coefficient of restitution while still maintaining a durable club. Because the three tiered approach is more efficient in creating the same coefficient of restitution as a dome shaped face, it is possible to redistribute the extra weight to either increase the moment of inertia or to lower the center of gravity of the golf club.

What has been described above are preferred embodiments of the present invention. However, one of ordinary skill in the art will recognize that many further combinations, permutations and modifications of the present invention are possible. Therefore, all such possible combinations, permutations and modifications are to be included within the scope of the claimed invention, as defined by the claims below.

What is claimed is:

1. A golf club head comprising:

a primary body having a top, a sole, a rear portion, and a perimeter weighting element;

wherein said rear portion carries a weighting element that protrudes rearwardly from said rear portion and said perimeter weighting element;

said rear portion having a toe section, a middle section, and a heel section, wherein said toe and heel sections are thinner than said middle section;

said perimeter weighting element defining a central cavity in said rear portion, wherein the depth of said central cavity is greater in said toe and heel sections than said middle section;

a forged front plate including a hosel, wherein said forged front plate is adapted to engage with said primary body to define a hollow interior;

said forged front plate having a top face portion, a middle face portion, and a sole face portion, wherein said sole face portion is thinner than said middle face portion and said top face portion is thinner than said sole face portion;

said forged front plate having a loft ranging from 18 degrees to 24 degrees; and said golf club head having a center of gravity less than 22 mm from said sole of said primary body.

* * * * *